US008893918B2

(12) United States Patent
Seo

(10) Patent No.: US 8,893,918 B2
(45) Date of Patent: Nov. 25, 2014

(54) CONTAINER FLOOR APPARATUS USING WOOD POLYMER COMPOSITE

(75) Inventor: Young Jun Seo, Seoul (KR)

(73) Assignee: Dong Yang C.M.I. Co., Ltd., Seoul (KR)

( * ) Notice: Subject to any disclaimer, the term of this patent is extended or adjusted under 35 U.S.C. 154(b) by 12 days.

(21) Appl. No.: 13/537,261

(22) Filed: Jun. 29, 2012

(65) Prior Publication Data

US 2013/0074443 A1 Mar. 28, 2013

(30) Foreign Application Priority Data

Sep. 26, 2011 (KR) ..... 10-2011-0097035

(51) Int. Cl.
*B65D 90/08* (2006.01)
*B65D 90/02* (2006.01)

(52) U.S. Cl.
CPC ..... *B65D 90/022* (2013.01); *B65D 90/023* (2013.01); *B65D 90/08* (2013.01)
USPC ..... 220/628; 220/1.5; 52/235; 52/284; 52/478; 52/762; 52/489.1; 52/588

(58) Field of Classification Search
CPC ..... B65D 90/08; B65D 90/022; B65D 90/023
USPC ..... 220/628, 1.5; 52/762, 235, 284, 478, 52/489.1, 588
See application file for complete search history.

(56) References Cited

U.S. PATENT DOCUMENTS 5,735,639 A * 4/1998 Payne et al. ..... 405/129.57

* cited by examiner

*Primary Examiner* — Elizabeth Volz
(74) *Attorney, Agent, or Firm* — Kirton McConkie; Evan R. Witt

(57) ABSTRACT

A container floor apparatus using wood polymer composite includes traverse supports continuously disposed to longitudinal frames at a predetermined interval, the longitudinal frames being longitudinally connected to vertical columns at four corners of the container. The longitudinal supports have a single central rail formed at upper portions of the traverse supports between the traverse frames and two side rails formed both sides of the central rail disposed parallel to and between the central rail and the longitudinal frames and further provided with a downwardly extending reinforcement piece. Convex floor members are made from wood polymer composite containing a cured mixture of about 30-50% of synthetic resin, about 50-70% of wood flour and chaff or pulp and about 2-10% of a binder. Gaskets surround each side surface portion of the floor members. Fixing means couple the floor members to the traverse supports in the block mounting spaces.

1 Claim, 5 Drawing Sheets

CONTAINER FLOOR APPARATUS USING WOOD POLYMER COMPOSITE

FIELD OF THE INVENTION

The present invention relates to a container floor apparatus using wood polymer composite, in which the floor part of the container is environmentally friendly, superior in stiffness and unlikely to be damaged by moisture, thereby largely improving the life span thereof.

BACKGROUND OF THE INVENTION

In general, a container is a large assembly box which is widely used for efficiently and economically conveying cargos. A cargo transfer container is used to be conveniently loaded and unloaded via an overland transport, marine transport, air transport or the like.

Such a container includes a container 100' main body in the shape of a rectangular box which is formed of a bottom surface, side surface portions and a ceiling portion as shown in FIG. 1, wherein all the bottom surface, the side surface portions and the ceiling portion are formed of panels 40' which are formed of steel materials and usually disposed with wood on the bottom of the inside thereof.

More specifically, the container main body has a structure, in which columns 10' are formed at four corners of the box, "L"-shaped longitudinal frames 20' are welded on the outer peripheral surface in the longitudinal direction with respect to the columns 10', and square bracket, "["-shaped traverse frames 30' are formed at a predetermined interval in the longitudinal frames 20', wherein the square bracket shaped traverse frames 30' are formed of a plurality of steel materials in the width direction in the longitudinal frames 20' and have both end surfaces are joined with the longitudinal frames 20' by welding.

In addition, natural wood in a predetermined size is disposed on the traverse frames 30' and then coupled therewith by coupling bolts, thereby forming a bottom surface in the container.

SUMMARY OF THE INVENTION

However, there is a disadvantage in the prior art that natural environment may be damaged and natural resources may be gradually exhausted if the floor part of the container is formed by mounting the natural wood.

In addition, the natural wood is likely to be damaged by moisture and dampness.

Therefore, there is a problem that if foodstuff or marine products which contain moisture are stacked therein and transported for a long time, the floor formed of wood is likely to be damaged and consequently should be substituted with a new one.

The present invention has been conceived in view of the above disadvantages and problems, and an object of the invention is to provide a container floor apparatus using wood polymer composite, wherein a floor plate is made using wood polymer composite, which is formed by compressing wood and synthetic resin, so as to improve durability, damp proof property, antibiotic action, heat insulation and sound insulation, thereby minimizing damage to maintained cargos regardless of seasons.

Another object of the invention is to provide a container floor apparatus using wood polymer composite, wherein a floor plate is made from wood polymer composite and the wood polymer composite is structured in a standardized block so as to improve the convenience of assembling work.

Still another object of the invention is to provide a container floor apparatus using wood polymer composite, wherein each side surface portion of a floor member is protected by a gasket such that thermal deformation may be actively absorbed by the gasket so as to improve durability may be obtained and convenient assembling work may be realized, simplifying manufacturing process.

In order to achieve the above objects, in a container for conveying cargos which are stacked in a rectangular box, a floor part of a container according to the present invention includes: traverse supports continuously disposed to longitudinal frames at a predetermined interval, wherein the longitudinal frames are provided at both end portions which are longitudinally connected to columns which are vertically mounted at four corners of the container; longitudinal supports having a single central rail disposed on upper portions of the traverse supports between the traverse frames, in which the central rail has a bottom surface with a downwardly opening box configuration in the center and base portions that extend outwardly from a lower edge of the center box configuration, and two side rails at both sides of the central rail disposed parallel to and between the central rail and the longitudinal frames, in which the side rails have a bottom surface with a downwardly opening box configuration in the center and a reinforcement piece is further provided that extends downwardly from the center box configuration; floor members made from wood polymer composite, wherein the wood polymer composite comprises a cured mixture of about 30-50% of synthetic resin, about 50-70% of wood flour and chaff or pulp and about 2-10% of a binder, and wherein the floor members are disposed in spaces between the traverse supports 21 and the longitudinal supports; gaskets surrounding each side surface portion of the floor members; and fasteners that couple the floor members, which are stacked on the traverse supports, to the traverse supports in the block mounting spaces.

According to the present invention as structured above, it is possible to improve the durability, the damp-proof property, the heat insulation and shock-absorption properties by forming floor members using wood polymer composite.

Further, it is possible to stably transport cargos, from which water may flow down, such as marine products for a long time without damage to the floor members.

Furthermore, it is possible to reduce time required for assembling work and increase convenience in the assembling work by making the floor part with standardized blocks of the floor members, and prevent the damage to the floor members by absorbing the thermal deformation, shock or the like of the floor members by means of the gaskets.

Furthermore, it is possible to provide environmentally friendly products, which do not cause damage to the nature, at a relatively low cost in comparison with natural wood.

BRIEF DESCRIPTION OF THE DRAWINGS

The above and other aspects, features and other advantages of the subject matter of the present disclosure will be more clearly understood from the following detailed description taken in conjunction with the accompanying drawings, in which.

DETAILED DESCRIPTION OF THE PREFERRED EMBODIMENTS

Figure 1:
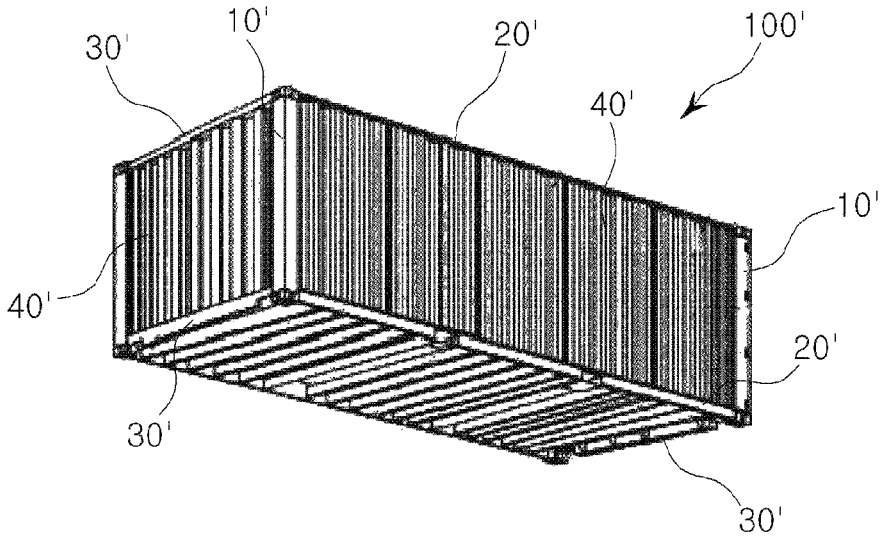
FIG. 1 is a perspective view showing the floor structure of a prior art container.
Figure 2:
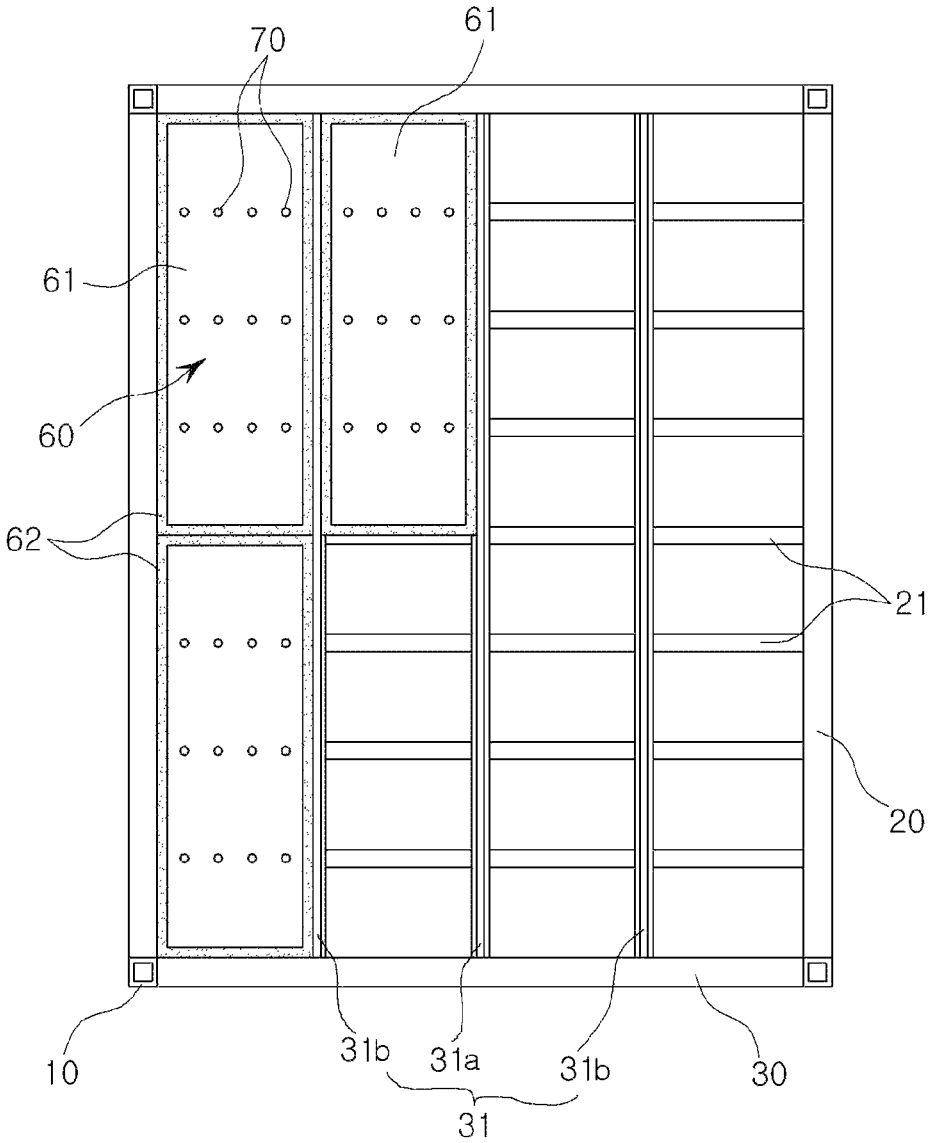
FIG. 2 is a cross sectional view of a container floor apparatus according to a preferred embodiment of the present invention.
Figure 3:
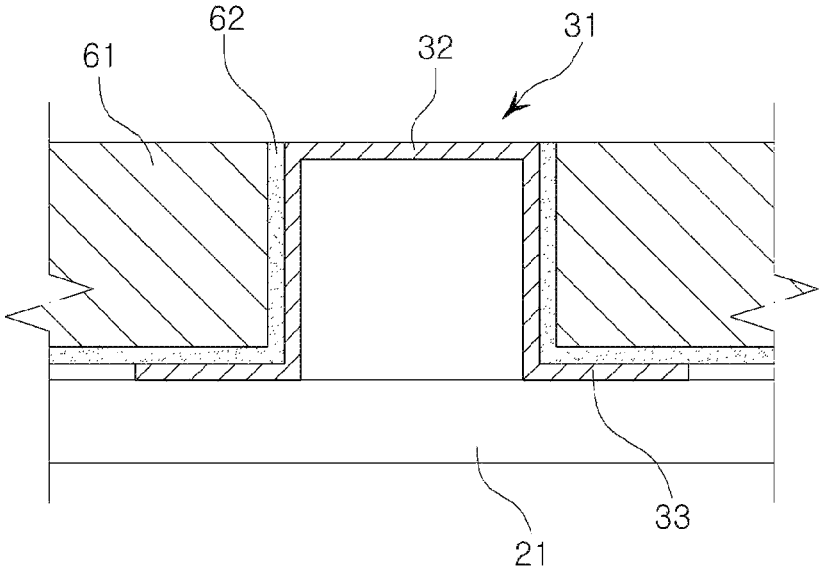
FIG. 3 is an expanded cross sectional view of a floor member according to the preferred embodiment of the present invention.

Hereinafter, an exemplary embodiment of the present invention will be described in view of the configuration and operations of the present invention with reference to accompanying drawings.

In a container floor apparatus using wood polymer composite according to the present invention, a floor member is formed using wood polymer composite and a floor part of a container is made using such floor members so that the manufacturing process of the floor part may be simplified while providing durable and environmentally friendly products.

A general container 100 is briefly explained in connection with the structure thereof. The general container 100 is formed in the shape of a rectangular box, and includes columns 10 provided at four corners, and traverse frames 30 and longitudinal frames 20 which are respectively connected to upper and lower portions of the columns 10 as a basic structure, wherein traverse and longitudinal frames 30, 20 are coupled with panels 40.

Further, referring to FIG. 2 to FIG. 6, the floor part of the container 100 structured as above are mainly provided with traverse supports 21 and longitudinal supports 31, of which both end portions are respectively welded to the traverse and longitudinal frames 30, 20 so as to form block mounting spaces, wherein the block mounting spaces are disposed with floor members 60 which are formed with wood polymer composite 61 in the shape of a block and then coupled by fasteners 70 with the supports.

The traverse supports 21 are disposed on the longitudinal frames 20 in the longitudinal direction at a predetermined interval such that both ends of the traverse supports 21 are welded with the longitudinal frames 20 to be fixed thereto, wherein the longitudinal frames 20 are at both ends connected to the columns 10 which are vertically mounted at four corners of the container 100.

Further, the longitudinal supports 31 are welded and fixed to the traverse frames 30, which are connected to the columns 10 in the width direction, at both ends thereof on the traverse supports 21, wherein it is important to mount three rails at a predetermined interval such that blocking mounting spaces in the shape of a grid may be defined between the traverse supports 21 and the longitudinal supports 31.

Figure 4A:
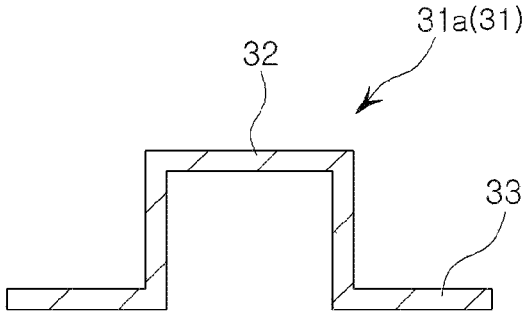
FIGS. 4*a* and 4*b* are expanded views showing the shape of a longitudinal support according to the preferred embodiment of the present invention.
Figure 4B:
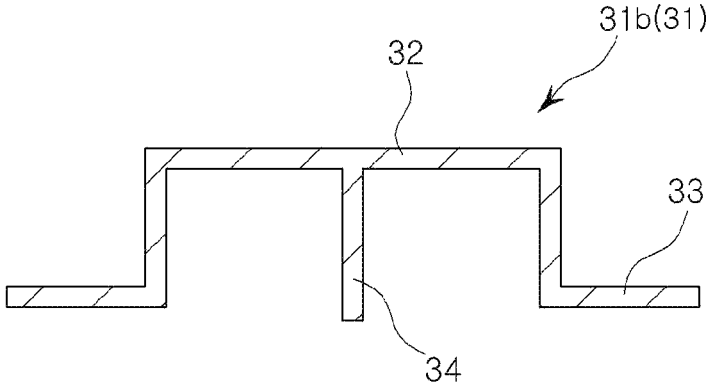

That is, the longitudinal support 31 includes a single central rail 31*a* having a cross-sectional shape shown in FIG. 4*a* ⊔⊓⊓⊔, in which a bottom surface 32 is formed with a downwardly opening box configuration in the center and base portions 33 extend outwardly from a lower edge of the center box configuration, and two side rails 31*b* having a cross-sectional shape shown in FIG. 4*b* ⊔⊓⊓⊔ at both sides of the central rail 31*a* disposed parallel to and between the central rail and the longitudinal frames 20, in which the side rails have a bottom surface with a downwardly opening box configuration in the center and a reinforcement piece 34 is further provided that extends downwardly from the center box configuration of the bottom surface 32.

The longitudinal support 31 is further provided with the side rails 31*b* at both sides of the central rail 31*a* so that the own weight of the container 100 as well as the weight of cargos which are received in the container 100 may be supported at the time of loading and unloading the cargos, wherein the durability of a body part may be further improved by the reinforcement pieces 34 of the side rails 31*b*.

As described above, the traverse supports 21 and the longitudinal supports 31 are mounted in the shape of a grid such that the floor members 60 are positioned in the concavely formed block mounting spaces and side surfaces thereof are supported by the longitudinal frames 20 and the base portions 33 of the longitudinal supports 31 in the longitudinal direction.

The floor member 60 described as above has a body part which is formed of wood polymer composite 61 and gaskets 62 which integrally surrounds each side surface portion of the body part, wherein the floor member 60 is formed in the shape of a block in a size which is standardized according to the block mounting space.

At this time, the wood polymer composite 61 is formed of the component ratio of about 30-50% of synthetic resin, about 50-70% of wood flour and chaff or pulp, and about 2-10% of a binder by extrusion molding, wherein the synthetic resin represents thermoplastic petroleum resin, for example, PP, PE, PVC, HIPS, ABS, PET or the like.

As the example of the binder, there are mineral fillers and lubricants, and additives such as colorants.

Figure 5:
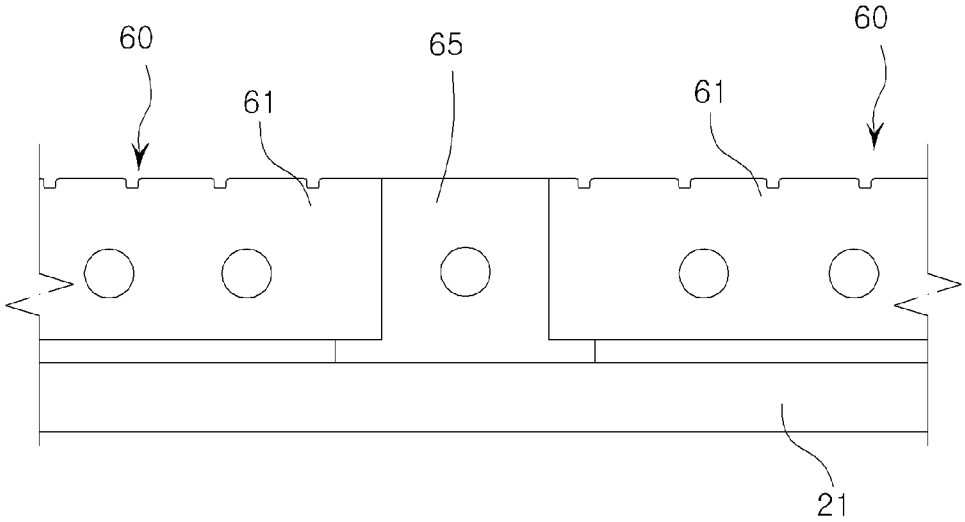
FIG. 5 is an expanded view showing the structure, in which a gasket is fitted into a gap between floor members.
Figure 6:
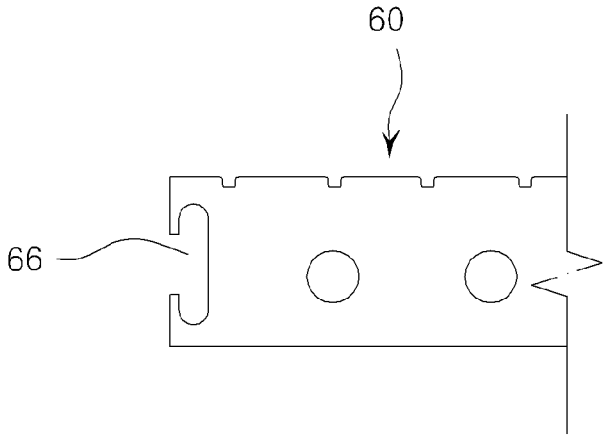
FIG. 6 is an expanded view showing the structure of a gasket mounting groove of a floor member which is positioned at an outermost position of the container.

And, it is preferable that the top surface of the wood polymer composite 61 has protrusions which are repetitively formed for preventing slippage and a plurality of holes which are formed in the center of a thickness portion so as to prevent the waste of materials and reduce weight, as shown in FIG. 5 and FIG. 6.

Further, the gasket 62 of the floor member 60 is formed of a synthetic rubber or resin material and coated on the bottom part or periphery of the wood polymer composite 61 or joined therewith by an adhesive such that the gasket 62 may absorb displacement when the floor member 60 is deformed by heat.

In addition, the gasket 62 exhibits buffering effects even a shock is generated.

Meanwhile, the plurality of floor members 60 are connected to the bottom of the container 100, wherein cushion gaskets 65 are preferably mounted between unit floor members 60 as shown in FIG. 5. The cushion gasket 65 is formed of a rubber material and has a hole in the center thereof such that absorption force may be improved and flexibility may be increased when the floor member 60 is retracted and expanded.

The cushion gasket 65 has a bottom surface, which is integrally formed with wing portions such that the cushion gasket 65 is fixed between the traverse supports 21 without movement.

Meanwhile, the floor member 60, which is positioned at the outermost wall of the container 100, is formed with a gasket mounting groove 66 such that the gasket which is formed in the shape corresponding to that of the gasket mounting groove 66 is coupled in the gasket mounting groove 66 without deviation.

The floor member 60 according to the present invention is formed in the shape of a block in a predetermined standard.

Therefore, even though the mounting length and width of the floor member 60 vary according to the standards of the container 100, the floor member 60 may be conveniently mounted in the block mounting space which is formed by the traverse supports 21 and the longitudinal supports 31, reducing assembling time while increasing working efficiency.

Further, the floor member 60 which is stacked at the upper portion of the traverse support 21 and the base portion 33 of the longitudinal support 31 in the block mounting space is coupled and fixed to the traverse support 21 by means of fasteners 70 such as a coupling screw.

Although the preferred embodiment of the present invention have been described for illustrative purposes, those skilled in the art will appreciate that various modifications, additions and substitutions are possible, without departing from the scope and spirit of the invention as disclosed in the accompanying claim.

| Brief Explanation of Reference Signs | |
|---|---|
| 10: column | 20: longitudinal frame |
| 21: traverse support | 30: traverse frame |
| 31: longitudinal support | 31a: central rail |
| 31b: side rail | 32: bottom surface |
| 33: base surface | 34: reinforcement piece |
| 40: panel | 60: floor member |
| 61: wood polymer composite | 62: gasket |
| 70: fasteners | 100: container |

What is claimed is:

1. A floor apparatus having a wood polymer composite for use in a stackable, rectangular box cargo container comprising:

traverse supports disposed between two longitudinal frames at a predetermined interval, wherein end portions of the longitudinal frames are connected to columns which are vertically mounted at four corners of the cargo container;

longitudinal supports having a single central rail disposed on upper portions of the traverse supports, in which the central rail has a horizontal bottom surface extending in a longitudinal direction and vertical side surfaces extending in the longitudinal direction, wherein the bottom surface and side surfaces form a downwardly opening box configuration in the center and horizontal base portions extend outwardly from a lower edge of the side surfaces, and two side rails at both sides of the central rail disposed parallel to and between the central rail and the longitudinal frames, in which the side rails have a horizontal bottom surface extending in the longitudinal direction and vertical side surfaces extending in the longitudinal direction, wherein the bottom surface and side surfaces form a downwardly opening box configuration in the center and a vertical reinforcement piece is further provided that extends downwardly from the bottom surface;

floor members made from the wood polymer composite, wherein the wood polymer composite comprises a cured mixture of about 30-50% of synthetic resin, about 50-70% of wood flour and chaff or pulp and about 2-10% of a binder, and wherein the floor members are disposed in spaces between the traverse supports and the longitudinal supports; the floor members have side surface portions;

gaskets surrounding each side surface portion of the floor members; and fasteners that couple the floor members to the traverse supports.

* * * * *